United States Patent [19]

Watkins

[11] Patent Number: 4,499,950

[45] Date of Patent: Feb. 19, 1985

[54] WELLHEAD STABILIZATION

[75] Inventor: Bruce J. Watkins, Rancho Palos Verdes, Calif.

[73] Assignee: Hughes Tool Company, Houston, Tex.

[21] Appl. No.: 499,069

[22] Filed: May 27, 1983

[51] Int. Cl.[3] ..... E21B 33/043

[52] U.S. Cl. ..... 166/285; 166/206; 166/362; 166/368; 166/382; 285/144

[58] Field of Search ..... 166/285, 368, 206, 207, 166/338, 362, 348, 382; 285/144, 145

[56] References Cited

U.S. PATENT DOCUMENTS

| | | | |
|---|---|---|---|
| 3,163,217 | 12/1964 | Haeber | 285/144 X |
| 3,195,638 | 7/1965 | Le Rouax | 166/368 |
| 3,273,915 | 9/1966 | Bishop et al. | 166/338 X |
| 3,367,002 | 2/1968 | Johnson | 285/144 X |
| 3,521,909 | 7/1970 | Brown | 166/338 X |
| 3,540,533 | 11/1970 | Morrill | 166/368 X |
| 4,334,342 | 6/1982 | Hall | 285/144 X |

*Primary Examiner*—Stephen J. Novosad
*Assistant Examiner*—Michael Starinsky
*Attorney, Agent, or Firm*—Robert A. Felsman; James E. Bradley

[57] ABSTRACT

A sub-sea well assembly has features to eliminate side-to-side movement between a wellhead and a wellhead housing due to movement of the drilling vessel. The wellhead extends into the wellhead housing and is connected on its upper end to equipment extending to the vessel. Slips are located in an annular space between the wellhead housing passage and the exterior wall of the wellhead. The slips are mounted so that they will slide from the contracted position when the wellhead is being placed into the wellhead housing to an expanded position after the wellhead is locked into the wellhead housing. In the expanded position, the slips move downward to wedge, but are not weight bearing. The slips are self-actuating, with a spring to urge them downward into the expanded position.

7 Claims, 5 Drawing Figures

WELLHEAD STABILIZATION

BACKGROUND OF THE INVENTION

1. Field of the Invention

This invention relates in general to offshore drilling equipment and in particular to a means for stabilizing a wellhead in a wellhead housing.

2. Description of the Prior Art

In one method of drilling offshore wells with floating vessels, a large diameter hole is first drilled or jetted, then conductor pipe is cemented in the large diameter hole with a wellhead housing at the top. The wellhead housing is supported by a guide structure that rests on the sea floor. A second hole of smaller diameter is then drilled. A first string called surface casing is lowered into this second diameter hole, with a wellhead at the top which is supported by the wellhead housing. A latch secures the wellhead to the wellhead housing to prevent upward movement.

Pressure sealing equipment is mounted to the top of the wellhead. A ball joint connects the pressure equipment to risers which extend to the drilling vessel. Drill pipe is lowered through the risers, pressure equipment, and wellhead for drilling the well to a further depth.

During drilling, the drilling vessel may drift or move laterally with respect to the wellhead. Although the ball joint allows a certain amount of movement, bending forces are exerted on the wellhead. There is an annular space between the wellhead and the wellhead housing that is normally filled with cement when the wellhead is set. This annular space allows some flexing of the wellhead within the wellhead housing. This side-to-side movement can cause fatigue in the casing directly below the wellhead and may result in parting of the casing.

SUMMARY OF THE INVENTION

To eliminate side-to-side movement between the wellhead and wellhead housing, a number of slips are located in the annular space between them. These slips are mounted so that they will slide between a contracted position when the wellhead is being lowered into the wellhead and an expanded, non-weight bearing position after the wellhead is latched. In the expanded position, the slips move into wedging engagement between the wellhead and wellhead housing. Additional side-to-side movement causes the slips to move downward and wedge even more tightly.

DESCRIPTION OF THE PREFERRED EMBODIMENT

Figure 1:
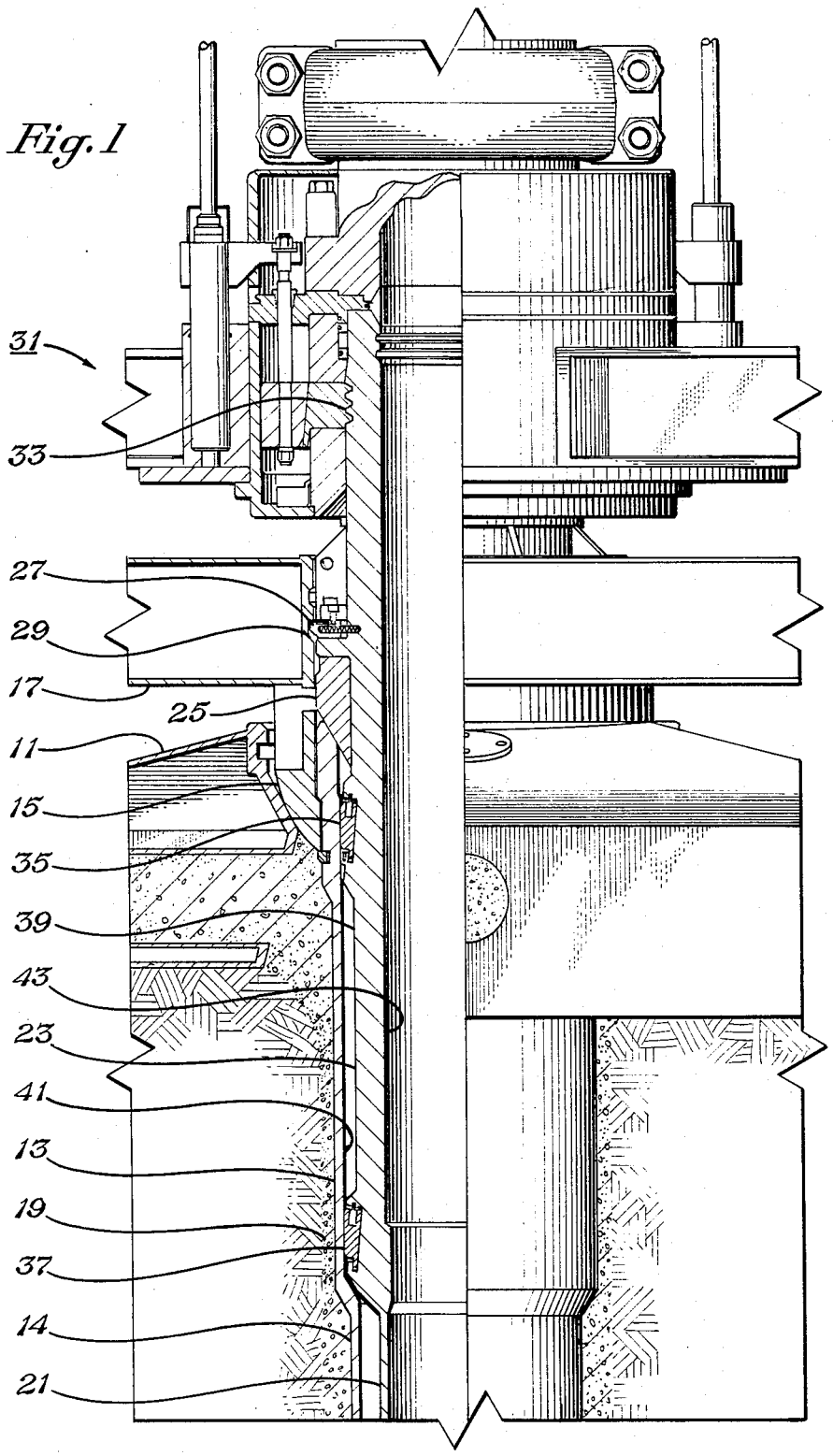
FIG. 1 is a vertical, partially sectioned view of a wellhead assembly constructed in accordance with this invention.

Referring to FIG. 1, the subsea connection or wellhead assembly of a typical well being drilled includes a temporary guide base 11. Guide base 11 is a relatively large structure that rests on the ocean floor and supports a wellhead housing 13. Wellhead housing 13 is connected to large diameter conductor pipe 14 and extends to a selected depth in the well. A permanent guide base 17 carrying a gimbal portion 15 rests in the temporary guide base 11 and carries the wellhead housing 13. Temporary guide base 11 and wellhead housing 13 are cemented in place by cement 19.

The well is further drilled to a selected depth for setting surface casing 21. Surface casing 21 is supported by a wellhead 23. A number of gussets 25 spaced around the top of the wellhead 23 serve as support means for supporting substantially all of the weight on the wellhead on the tapered or beveled mouth of wellhead housing 13. Wellhead 23 lands on wellhead housing 13 which in turn fits within the permanent guide base 17 and is secured by a latch 27 that latches into an annular groove 29. Latch 27 serves as latch means for preventing substantially all vertical movement of wellhead 23 relative to wellhead housing 13. Conventional pressure control equipment 31 is mounted to wellhead 23 by connection means comprising radial grooves 33 formed on the top of the wellhead 23. The pressure control equipment extends upwardly and is connected to risers by means of a ball joint (both not shown). The risers lead to a floating vessel (not shown).

Upper and lower sets of slips 35 and 37 are mounted in the annular space between the exterior wall 39 of wellhead 23 and the wellhead axial passage 41. Each of the slips 35 and 37 comprise individual wedge segments spaced-apart from each other in a circular or circumferential array extending around the wellhead 23. The upper slips 35 are located so as to be near the top of wellhead housing 13 when wellhead 23 is installed. The lower slips 37 are also in a circular array, but are spaced vertically downward from upper slips 35 so as to be located near the bottom of wellhead 23 and wellhead housing 13. Slips 35 and 37, once set, prevent side-to-side movement between wellhead 23 and wellhead housing 13. Wellhead 23, like wellhead housing 13, has an axial passage 43 extending through it.

Figure 4:
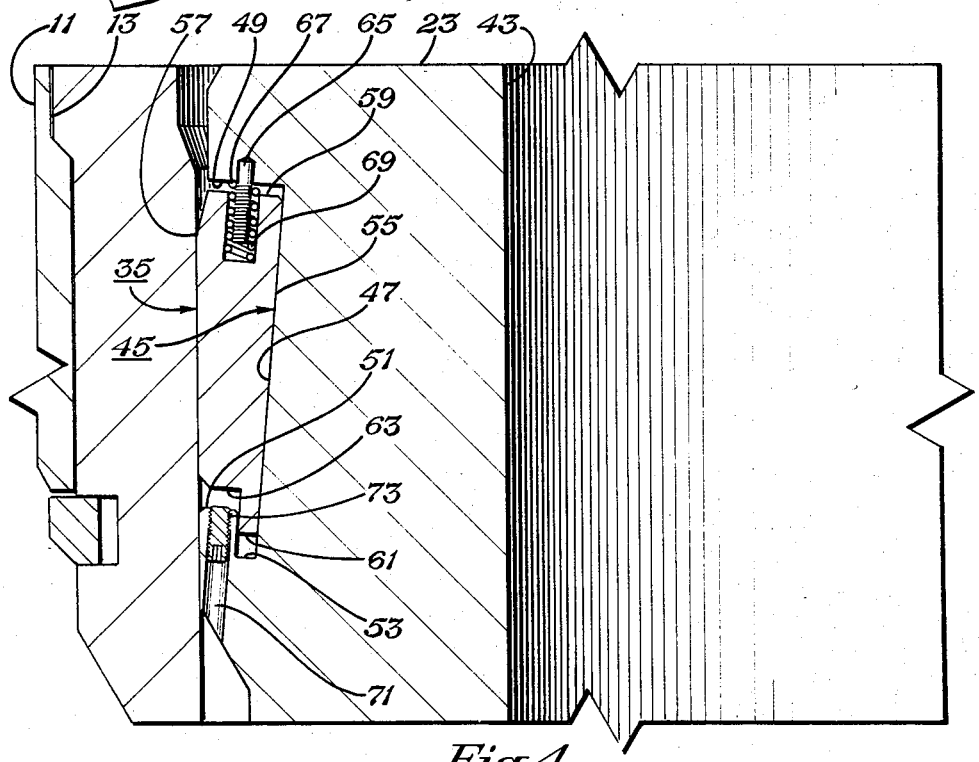
FIG. 4 is a further enlarged view of a portion of the wellhead assembly of FIG. 1.

Referring to FIG. 4, each slip 35 and 37 is located within a slip holder that includes a recess 45. Recess 45 has an outwardly facing wall 47 that is located in a single plane. Wall 47, if projected, would intersect the axis of wellhead passage 43 at an acute angle. Recess wall 47 inclines outwardly when measured from the top to the bottom, making the bottom of recess 45 of less depth than its top. Recess 45 also has a shoulder 49 that is perpendicular to recess wall 47 and faces downwardly. On the lower end, a lip 51 extends upwardly and has an upper edge that is parallel to recess shoulder 49. Lip 51 is spaced from recess wall 47, defining a clearance or channel 53 between lip 51 and wall 47.

Figure 3:
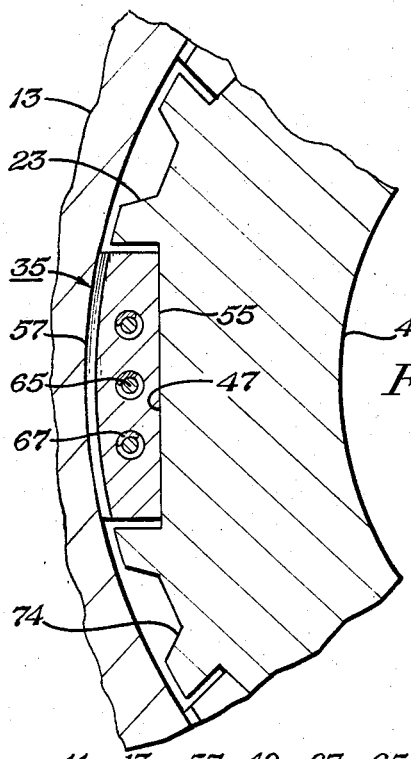
FIG. 3 is a sectional view of part of the wellhead assembly of FIG. 1, taken along the line III—III of FIG. 2.
Figure 5:
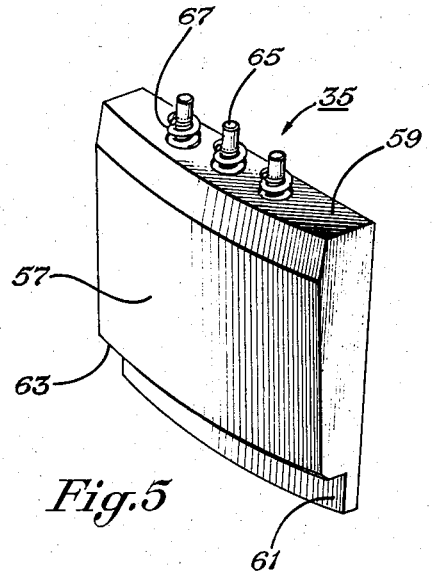
FIG. 5 is a perspective view of one of the slips used with the wellhead assembly of FIG. 1.

Each slip 35 and 37 has an inner wall 55 that is flat for slidingly engaging the recess wall 47. Each slip 35 and 37 has an outer wall 57 that is curved to be a segment of a cylinder, as shown in FIG. 3. The radius of curvature is the same as the radius of the wellhead housing passage 41. Also, the slips 35 and 37 are tapered in thickness so that the outer wall 57 is vertical and mates flush with the wall of the wellhead housing passage 41. The outer wall 57 is a segment of a cylinder that would have an axis that coincides with the axis of the wellhead passage 43. This results in the slips 35 and 37 having a thickness that tapers or reduces from the top to the bottom.

Each slip 35 and 37 also has a top edge 59 that is perpendicular to the inner wall 55. On the lower end, a lip 61 is formed by means of a lower shoulder 63. Lip 61 has a reduced width for close, sliding reception within channel 53. Lip 61 and channel 53 serve as lower retaining means for retaining the lower portion of each slip 35 and 37, but allowing the slip to slide up and down in recess 45. The upper end of each slip 35 and 37 is retained by upper retaining means comprising three pins 65 that are mounted in a cavity in shoulder 49. Each pin 65 extends downwardly into a larger cavity 69 formed in each slip 35 and 37. Cavity 69 is larger in diameter than pin 65 to accommodate a coil spring 67 that encircles pin 65. Spring 67 is compressed between shoulder 49 and the base of cavity 69 to serve as bias means for urging the slips 35 or 37 downward.

A threaded passage 71 extends through lip 51 and has an axis that is perpendicular to lower shoulder 63. A screw 73 is located in passage 71. Screws 73 can be rotated to push slips 35 and 37 upward to release the wedging action, should one wish to remove the wellhead 23 from the wellhead housing 13 in case of abandonment of the well. Portions of wellhead housing 13 must be cut away and cement removed to expose passages 71 to perform this salvaging operation.

As shown in FIG. 3, longitudinal splines or grooves 74 are formed in the exterior wall of wellhead 23. Grooves 74 extend vertically between and past the upper and lower slips 35 and 37. Each of the slips 35 and 37 is separated from adjacent slips 35 and 37 by a groove 74. Grooves 74 allow cement to flow between the slips 35 and 37 to return to the top of wellhead housing 13.

In installing the wellhead 23, prior to entry into the wellhead housing 13, the slips 35 and 37 will be in an expanded position due to the force of springs 67 acting on the bottom of cavities 69. In the expanded position, the base of lip 61 will be in contact with the bottom of channel 53. Outer wall 57 will be at its maximum diameter, protruding outwardly a slight distance past lip 51. Surface casing 21 (FIG. 1) will be secured to the bottom of wellhead 23. As the wellhead 23 is lowered into the wellhead housing passage 41, the outer walls 57 of the slips 35 and 37 will contact the wall of the wellhead housing passage 41 in sliding engagement. The frictional force will push the slips 35 and 37 upwardly, compressing springs 67. In the contracted position, as the wellhead 23 moves downward in wellhead housing 13, the upper edge 59 of slips 35 may likely contact the recess shoulder 49. In this contracted position, the diameter of the slip sets at the outer walls 57 is reduced from that of the expanded position because of the inclination of the recess wall 47 and the taper of the slips 35 and 37.

Figure 2:
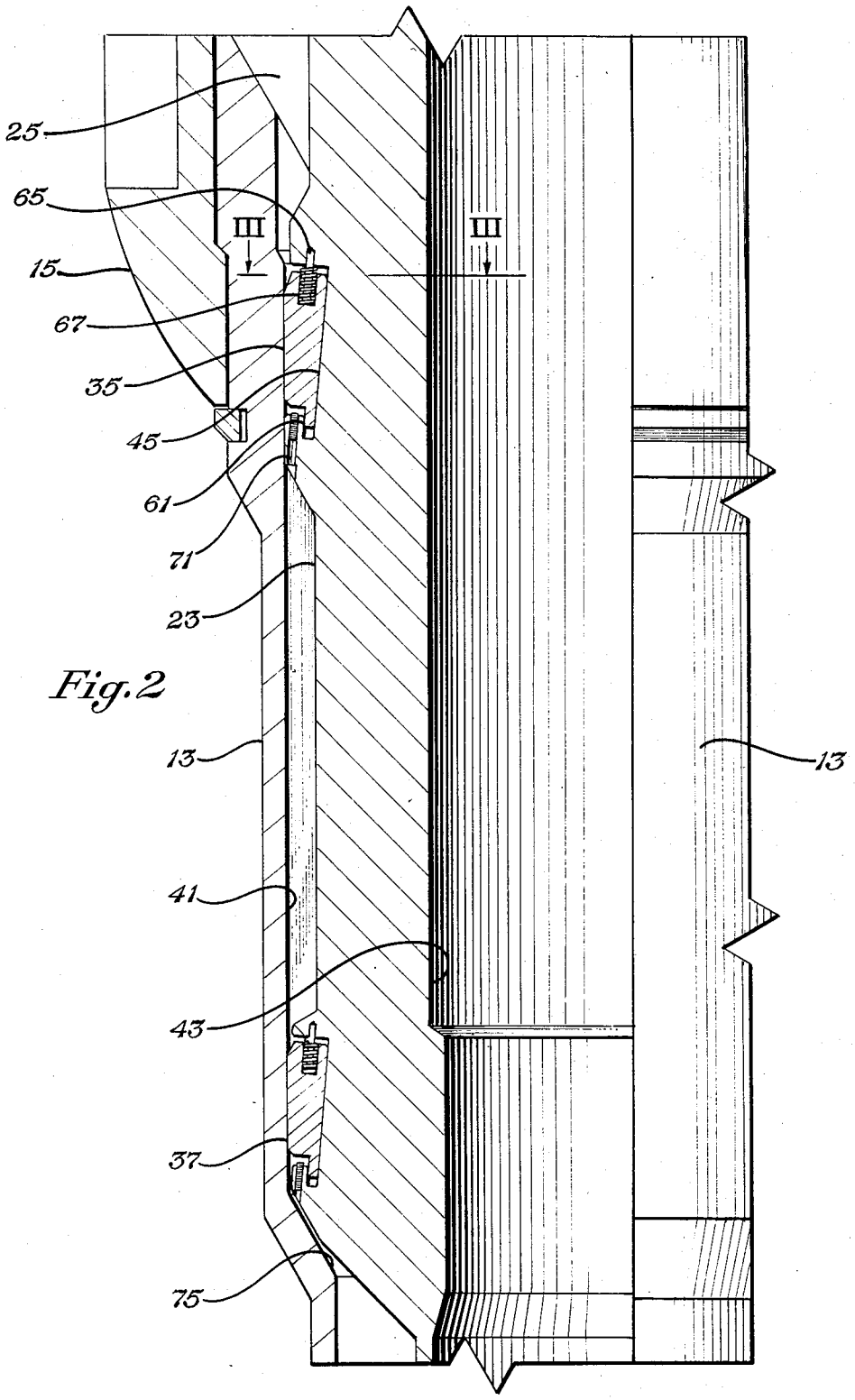
FIG. 2 is an enlarged view of a portion of the wellhead assembly of FIG. 1.

As shown in FIG. 1, when the wellhead gussets 25 contact the tapered edge of the mouth of the wellhead housing 13, further downward movement will be stopped, with gussets 25 supporting the weight. Latch 27 will be locked into groove 29 to prevent any upward movement which might occur due to thermal growth in well casing. Latch 27, groove 29 and gussets 25 serve as locking means to prevent upward and downward movement of the wellhead 23 with respect to the wellhead housing 13. When locked into position, as shown in FIG. 2, a clearance 75 will exist between the point at which the wellhead housing 13 is connected to the conductor pipe 14, and the lower tapered edge of the wellhead 23.

Once supported at the top against vertical movement, as shown in FIG. 4, springs 67 will push the slips 35 and 37 downwardly. As the slips 35 and 37 move downward, because of the taper of the slips and the inclination of the recess wall 47, the diameter of the slip sets at the outer walls 57 increases. The outer walls 57 engage the walls of the passage 41. Rocking or side-to-side forces exerted by movement of the drilling vessel cause the slips 35 and 37 to slip even further downward, tightly wedging the wellhead 23 to the wellhead housing 13. Cement is pumped downward into the surface casing 21, returning up the annular space between the conductor pipe 14 and the surface casing 21. The cement returns upward through grooves 74 between the slips 35 and 37, between the wellhead 23 and the wellhead housing 13, and between the flanges 25, to flow out on top of the temporary guide base 11. The slips 35 and 37 are non-weight bearing, with the weight on wellhead 23 from pressure equipment 31, being transmitted to wellhead housing 13 by means of gussets 25.

The invention has significant advantages. The slips rigidly lock the inner member or wellhead within the wellhead housing or outer member to prevent side-to-side movement. This reduces the chance for fatigue to occur that might result in parting of the wellhead and a possible blowout. The slips are self-actuating and require no additional equipment or trips into the well to set them.

While the invention has been shown in only one of its forms, it should be apparent to those skilled in the art that it is not so limited but is susceptible to various changes without departing from the scope of the invention.

I claim:

1. In a sub-sea well assembly of the type having an outer member mounted at the top of the well, an inner member protruding upwardly from the outer member and having connection means for connecting to the riser equipment extending to a drilling vessel, the lower end of the inner member being connected to a string of casing, an improved means for mounting the inner member within the outer member, comprising in combination:

supporting means for supporting with the outer member substantially all of the weight on the inner member and means for preventing substantially all vertical movement of the inner member with respect to the outer member;

a plurality of slips located in two vertically spaced-apart sets in an annular space between the outer member and the inner member; and mounting means for mounting the slips for sliding movement between a contracted position when the inner member is being lowered into the outer member and an expanded position wedging between the inner member and the outer member after the weight on the inner member is supported by the supporting means, to prevent side-to-side movement of the inner member with respect to the outer member.

2. In a sub-sea well assembly of the type having an outer member mounted at the top of the well, an inner member secured within the outer member, the inner member having connection means on its upper end for connection to riser equipment extending to a drilling vessel and a string of casing secured to its lower end, an improved means for mounting the inner member in the outer member, comprising in combination:

supporting means for supporting with the outer member substantially all of the weight on the inner member and means for preventing substantially all vertical movement of the inner member relative to the outer member;

a plurality of slips mounted to an exterior wall of the inner member in two vertically spaced-apart sets, the slips in each set being circumferentially spaced-apart;

mounting means for mounting the slips to the exterior wall for sliding movement between a contracted position when the inner member is being inserted into the outer member and an expanded position wedging between the inner member and the outer member after the inner member is supported by the supporting means; and groove means extending vertically along the exterior wall between the sets of slips, for allowing the return flow of cement from an annulus surrounding the casing to above the slips.

3. In a sub-sea well assembly of the type having a wellhead housing mounted at the top of the well, an improved method of mounting a wellhead within the wellhead housing, comprising in combination:

mounting a plurality of slips in two vertically spaced-apart sets around an exterior wall of the wellhead so as to be movable between a contracted position and an expanded position of larger diameter;

mounting a locking means to the wellhead for supporting the weight of the wellhead on the wellhead housing and also for preventing upward movement of the wellhead;

securing casing to the lower end of the wellhead and lowering the casing and wellhead into the well until the locking means engages the wellhead housing to prevent vertical movement of the wellhead; then moving the slips downward to wedge between the wellhead and the wellhead housing, to prevent side-to-side movement of the wellhead with respect to the wellhead housing; then pumping cement down the casing to return upward between the wellhead and wellhead housing and through the slips; then allowing the cement to harden.

4. In a sub-sea well assembly of the type having a tubular outer member mounted at the top of the well, an inner member located within a passage of the outer member and having connection means on its upper end for connection to equipment extending to a drilling vessel, an improved means for mounting the inner member in the outer member, comprising in combination:

supporting means for supporting with the outer member substantially all of the weight on the inner member:

latch means for preventing substantially all vertical movement of the inner member relative to the outer member;

a plurality of recesses located in two sets in an exterior wall of the inner member, the sets being spaced-apart vertically from each other, each recess in each set being circumferentially spaced-apart from adjacent recesses;

each recess having an outwardly facing wall that inclines outward from top to bottom;

a slip reciprocally carried by the inner member in each recess, each slip having an inclined inner wall that slidingly mates with the recess wall and an outer wall that is curved and vertically oriented to mate with the outer member passage; and bias means for urging each of the slips downwardly to wedge between the outer member passage and the recess wall to prevent side-to-side movement of the inner member with respect to the outer member.

5. In a sub-sea well assembly of the type having an outer member mounted at the top of the well, an inner member mounted within the outer member by supporting means for supporting with the outer member substantially all of the weight on the inner member and by means for preventing substantially all vertical movement of the inner member with respect to the outer member, the inner member having connection means on its upper end for connection to equipment extending to a drilling vessel, an improved means for preventing side-by-side movement of the inner member with respect to the outer member as the vessel moves, comprising:

a plurality of recesses located in two sets in an exterior wall of the inner member, each set being spaced-apart vertically from the other set, the recesses within each set being circumferentially spaced-apart from adjacent recesses;

each recess having at its upper end a downwardly facing shoulder and an outwardly facing wall that inclines outwardly;

a slip with a tapered vertical cross-section reciprocally carried by the inner member in each recess, each slip having an upper edge, an inclined inner wall that slidingly mates with the recess wall, and an outer wall that is curved and vertically oriented to mate with the outer member passage;

bias means mounted between the recess shoulder and the slip upper edge for urging the slip downward in the recess to wedge against the outer member passage; and retainer means at the bottom of each of the recesses for retaining the slips in the recess, but allowing sliding movement of the slips in the recesses.

6. In a sub-sea well assembly of the type having an outer member mounted at the top of the well, an inner member secured within a passage of the outer member by locking means for preventing vertical movement, the inner member having connection means on its upper end for connection to equipment extending to a drilling vessel, an improved means for preventing side-to-side movement of the inner member with respect to the outer member as the vessel moves, comprising:

a plurality of recesses located in two sets in an exterior wall of the inner member, each set being spaced-apart vertically from the other set, the recesses within each set being circumferentially spaced-apart from adjacent recesses;

each recess having at its upper end a downwardly facing shoulder, an outwardly facing wall that inclines down to a lip, the lip extending upwardly and being spaced from the recess wall to define a channel;

a slip reciprocally carried by the inner member in each recess, each slip having an upper edge, a lower edge, an inclined inner wall between the edges that slidingly mates with the recess wall, and an outer wall that is curved and vertically oriented to mate with the outer member passage;

upper retainer means carried by the upper edge of the slip and the shoulder for retaining the slip in the recess, but allowing sliding movement of the slip in the recess;

bias means between the recess shoulder and the upper edge of the slip for urging the slip downward in the recess to wedge against the outer member passage;

the slip having a flange on its lower edge slidingly received in the channel;

passage means extending through the lip for providing access to a lower portion of the slip to force the slip back upward into the recess to withdraw the inner member from the outer member; and a longitudinal groove extending vertically along the inner member exterior wall between the sets of slips for communicating fluid from below the lower set of slips to above the upper set of slips.

7. In a sub-sea well assembly of the type having a wellhead housing mounted at the top of the well, a wellhead protruding upwardly from a passage in the wellhead housing, the wellhead having connection means on its upper end for connection to a riser string, the lower end of the wellhead adapted to be connected to a string of casing, an improved means for mounting the wellhead in the wellhead housing, comprising in combination:

supporting means connected to the wellhead for supporting with the wellhead housing substantially all of the weight on the wellhead;

latch means mounted to the wellhead for engaging the wellhead housing to prevent substantially all vertical movement of the wellhead relative to the wellhead housing;

a plurality of slip holders located in two vertically spaced-apart sets in an exterior wall of the wellhead, each slip holder having an outwardly facing wall that inclines outwardly from top to bottom;

a slip slidingly mounted in each slip holder, each slip having an inclined inner wall that slidingly mates with the slip holder wall and an outer wall that is vertically oriented to mate with the wellhead housing passage;

the slip holder wall having a greater length than the length of the slip inner wall; and means for moving the slips downward in the slip holders to wedge between the slip holder walls and the wellhead passage to prevent side-to-side movement of the wellhead relative to the wellhead housing.

* * * * *